US007315627B1

(12) United States Patent
Cox et al.

(10) Patent No.: US 7,315,627 B1
(45) Date of Patent: Jan. 1, 2008

(54) SOUND-DAMPING LAMINATE FOR LOUDSPEAKER STRUCTURE

(75) Inventors: David H. Cox, Chatsworth, CA (US); Bernard M. Werner, Los Angeles, CA (US); William J. Gelow, Thousand Oaks, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 0 days.

(21) Appl. No.: 10/919,697

(22) Filed: Aug. 16, 2004

Related U.S. Application Data

(63) Continuation of application No. 09/521,522, filed on Mar. 8, 2000, now abandoned.

(60) Provisional application No. 60/123,351, filed on Mar. 8, 1999.

(51) Int. Cl.
*H04R 25/00* (2006.01)

(52) U.S. Cl. ..... 381/353; 381/152; 381/431

(58) Field of Classification Search ..... 381/152, 381/337–341, 354, 161, 423–428, 430–432; 181/151–152, 159, 167–170, 175, 180
See application file for complete search history.

(56) References Cited

U.S. PATENT DOCUMENTS 3,982,607 A * 9/1976 Evans ..... 181/152
4,369,857 A * 1/1983 Frazer et al. ..... 181/159
6,332,029 B1 * 12/2001 Azima et al. ..... 381/152

* cited by examiner

*Primary Examiner*—Suhan Ni
(74) *Attorney, Agent, or Firm*—The Eclipse Group LLP

(57) ABSTRACT

A sound-damping structure is provided for use as part of a sound-directing component of a loudspeaker. The structure includes a first structural layer, a second structural layer, and a core layer enclosed between the first and second structural layers. The first and second structural layers include a generally rigid material, and the core layer includes a sound-damping material. The first structural layer includes an outside surface facing an exterior of the sound-directing component. The second structural layer includes an inside surface having an interior of the sound-directing component through which sound energy is directed.

29 Claims, 5 Drawing Sheets

SOUND-DAMPING LAMINATE FOR LOUDSPEAKER STRUCTURE

RELATED APPLICATIONS

This application is a continuation of U.S. patent application Ser. No. 09/521,522 filed on Mar. 8, 2000 now abandoned and titled "SOUND-DAMPING LAMINATE FOR LOUDSPEAKER STRUCTURE", which claims priority to U.S. Provisional Application Ser. No. 60/123,351 filed on Mar. 8, 1999, of which the entire content of both applications is incorporated by reference in this application.

BACKGROUND OF THE INVENTION

1. Field of the Invention

This invention relates generally to the field of loudspeakers. More particularly, the invention relates to the imparting of sound-damping properties to one or more structures or components of a loudspeaker.

2. Related Art

An audio loudspeaker system typically includes a driver unit that serves as an electroacoustic transducer. Electrical signals encoding auditory information are fed to the driver unit, and the driver unit converts the electrical signals to acoustic signals. The acoustic signals propagate through a suitable fluid medium, such as air, in the manner of waves. The pressure differences in the medium characterized by these waves are interpreted by a listener as sound. The quality of the auditory signal produced from a driver unit can be improved or enhanced by coupling the driver unit to an appropriate sound-directing structure that encloses a volume of medium to which sound waves are first received from the driver unit. A horn is one example of a sound-directing structure. Typically, a horn includes one open end coupled to the driver unit and another open end or mouth downstream from the driver-side end from which sound waves disperse to a listening area. The mouth may be formed as part of a waveguide connected to the horn, or the sound-directing structure may be characterized as being either a horn or a waveguide. The horn often has a flared design such that the interior defined by the horn expands or increases from the driver-side end to the mouth. The structure of the horn (or waveguide) and thus its interior can be shaped so as to guide the sound waves according to desired criteria, such as concentrating and/or directing the sound waves.

In the design and manufacture of audio loudspeakers, horns, waveguides, or other enclosures or structural features typically include regions that constitute flat or curved panels, and that are desired for imparting stiffness or rigidity for mechanical and/or acoustic purposes. In addition to providing structural characteristics, it may be desirable for these regions to also provide acoustic damping properties for sound absorption, deadening, and isolation, particularly between opposing inside and outside surfaces of such panel-like structures. As an example, in the throat portion of the horn of a loudspeaker, the internal surface is exposed to a field of high-energy sound pressure produced by the driver. At the exterior surface opposite to the internal surface, sound vibrations are unwanted due to their potential influence on the directivity and overall acoustic performance of the loudspeaker. This problem can stem from one or more resonance effects within the audio frequency range as determined by physical considerations such as mass and compliance. Accordingly, for many implementations it would be desirable that an isolating or dampening means be employed to ameliorate any adverse effect of such sound vibrations at the exterior side of the throat portion of a horn or other sections of a sound-directing component of a loudspeaker.

One approach to addressing this problem is to make certain parts of the loudspeaker thicker and thus more massive and rigid. This approach, however, is often undesirable because it results in an unacceptable increase in weight, cost and size.

An alternative approach may be strategically deploying damping material at one or more parts of the loudspeaker to suppress resonant effects by lowering the Q of the mechanical resonance, thereby causing a portion of the unwanted acoustic energy to be dissipated by conversion into heat energy, rather than transmitted to the interior and exterior surfaces. A coating of adherent, flexible, elastic or visco-elastic material may be formulated and applied to exterior surfaces of a loudspeaker to provide the required balance of stiffness, mass and damping. For many implementations, and particularly commercial implementations, this approach is considered to be unacceptable due to reliability problems as well as aesthetic and marketing disadvantages.

Therefore, there is a need for providing loudspeakers or loudspeaker components with sound-damping properties that overcome the disadvantages set forth above and others previously experienced. For loudspeakers or loudspeaker components requiring one or more flat and/or curved panel-like regions that have hard surfaces to impart stiffness to the loudspeaker, there is a need for providing such regions with the ability to attenuate through-panel sound transmission and suppress resonances. There is also a need for providing a sound-damping structure for a loudspeaker that exhibits a balance of stiffness, mass and damping, along with the ability to selectively address potential resonant frequencies in certain structural configurations. There is also a need for providing a sound-damping structure for a loudspeaker that can be economically manufactured in a simple process using commercially available materials.

SUMMARY

The invention provides a sound-damping structure for a loudspeaker that includes a sound-damping core material embedded within its structure. In one implementation of the invention, a sound-damping structure is provided for use as part of a sound-directing component of a loudspeaker. The structure comprises a first structural layer, a second structural layer, and a core layer enclosed between the first and second structural layers. The first and second structural layers include a generally rigid material, and the core layer includes a sound-damping material. The first structural layer includes an outside surface facing an exterior of the sound-directing component. The second structural layer includes an inside surface facing an interior of the sound-directing component through which sound energy is directed.

In another implementation, a loudspeaker component comprises a first surface layer, a core layer, and a second surface layer. The first surface layer includes a molding material and has a boundary outline. The core layer includes a sound-damping material. The core layer has a boundary outline smaller than that of the first layer such that the first layer forms a peripheral margin of molding material at the boundary outline of the core layer. The margin extends to form a throat for directing sound energy of the loudspeaker. The second surface layer includes the molding material and has a boundary outline similar to that of the first surface layer and is located in substantial registration with the first surface layer. The second surface layer is adjoined to the first surface layer at the peripheral margin so as to form a sealed core region in which the core layer is disposed.

In another implementation, a loudspeaker component comprises a first layer, a second layer, and sound-damping material. The second layer is fixed to the first layer to define a core and a margin. The margin includes a first flange and a second flange. The first and second flanges extend to form a throat to direct the sound of the loudspeaker. The sound-damping material is disposed in the core so as to be completely encased by the first and second layers.

In another implementation, a loudspeaker comprises a driver and a horn coupled to the driver for directing sound energy produced by the driver. The horn includes a wall. The wall includes structural material and a core of sound-damping material embedded in the structural material. The structural material includes an inside surface facing an interior of the horn through which sound energy is directed.

Other apparatus, systems, methods, features, components and/or advantages of the invention or will become apparent to one with skill in the art upon examination of the following figures and detailed description. It is intended that all such additional apparatus, systems, methods, features, components and/or advantages be included within this description, be within the scope of the invention, and be protected by the accompanying claims.

BRIEF DESCRIPTION OF THE FIGURES

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
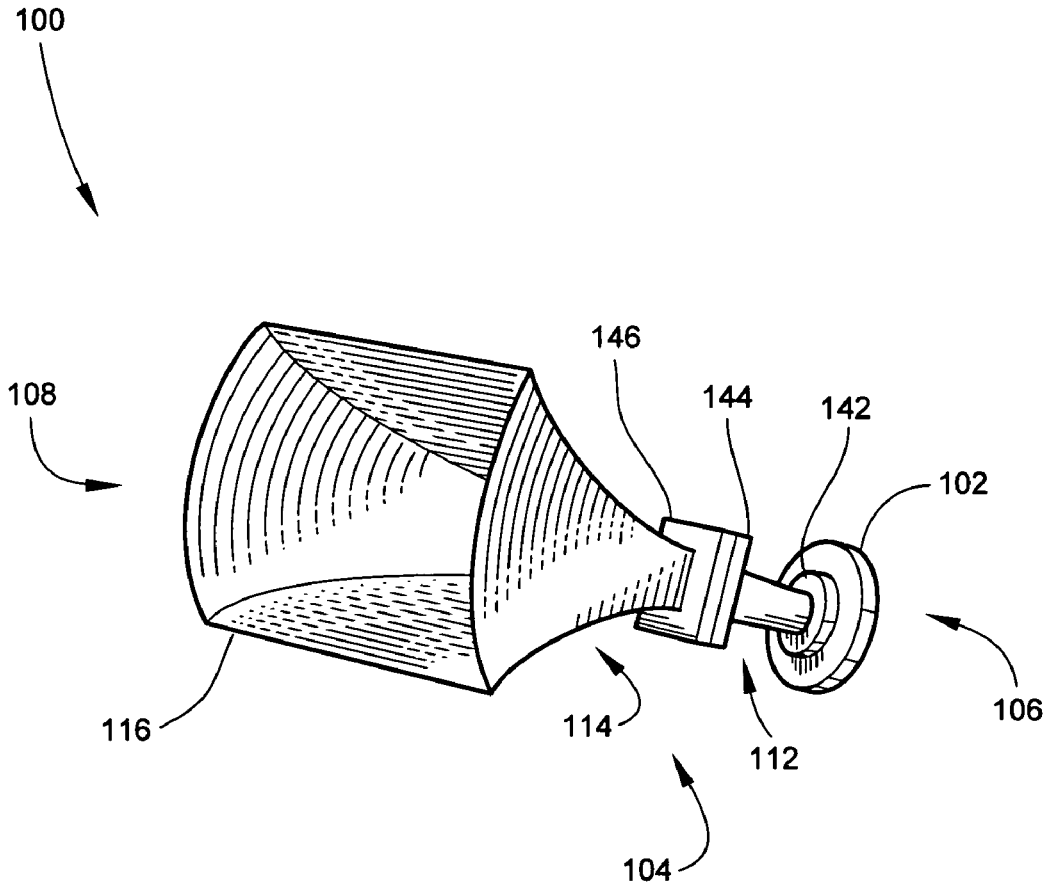
FIG. 1 is a perspective view of an example of a loudspeaker in which a sound-damping structure can be implemented according to an embodiment of the subject matter disclosed in the present disclosure.

FIG. 1 illustrates a perspective view of a loudspeaker 100 according to one implementation of the invention. Loudspeaker 100 defines one or more interior spaces through which waves of acoustic energy propagating from a suitable acoustic energy source such as a driver or electroacoustic transducer 102 can be guided to a listening area. Loudspeaker 100 can operate in any suitable listening environment such as the room of a home, a theater, or a large indoor or outdoor arena. Moreover, loudspeaker 100 can be sized to process any desired range of the audio frequency band, such as a high range (generally 2 kHz-20 kHz) typically produced by tweeters, a midrange (generally 200 Hz-5 kHz) typically produced by midrange drivers, and a low range (generally 20 Hz-1 KHz) typically produced by woofers. In some implementations, loudspeaker 100 is mounted such that its elongated or dominant dimension is oriented vertically. In other implementations, loudspeaker 100 can be mounted horizontally or at an oblique angle relative to vertical. Accordingly, for the purpose of the present disclosure, it will be understood that terms such as "vertical", horizontal", "top", "bottom", "upper", "lower" and the like are expressed in a relative sense and not as a limitation on any particular orientation of loudspeaker 100 or its associated features and components. If desired, loudspeaker 100 could be integrated with other similar or different types of loudspeakers, operating at similar or different frequency bands, in a suitable cabinet or housing (not shown) as appreciated by persons skilled in the art.

By way of example, as shown in FIG. 1, loudspeaker 100 typically includes a driver 102 coupled with one or more loudspeaker components designed to contain and guide the propagation of sound energy produced by and emanating from driver 102. For example, loudspeaker 100 can include one or more components that provide an enclosure or housing such as a horn 104 that extends generally from a rear end 106 to a front end 108 of loudspeaker 100. Horn 104 communicates with an output side of driver 102 such that horn 104 directs sound energy produced by driver 102 to an intended listening area according to appropriate design parameters. Horn 104 can be molded as a unitary structure or as two or more portions or sections that are assembled together by any suitable means (e.g., bonding, fastening, or the like). For instance, horn 104 can include a throat section 112 communicating with driver 102 and a waveguide section 114 communicating with throat section 112. Waveguide section 114 terminates at front end 108 of loudspeaker 100 at a continuous, uninterrupted mouth 116 from which sound waves emanate to the ambient environment. The waveguide section 114 may also be referred to as the mouth of the horn 104. Moreover, throat section 112 and waveguide section 114 can each be initially provided as symmetrical or similar half-sections that are assembled together by any suitable means (e.g., bonding, fastening, or the like). Throat section 112 can also include a radial web or flange 142 to facilitate coupling with driver 102, and a radial web or flange 144 to facilitate coupling with a corresponding web or flange 146 of waveguide section 114.

Generally, as appreciated by persons skilled in the art, loudspeaker 100 and the structural features defined by loudspeaker 100 can be fabricated by any appropriate technique and from any material suitable for the guiding of sound waves and providing structural integrity, one example being molded polymeric materials. Throat section 112 and/or waveguide section 114 can be shaped as appropriate for directing sound energy from driver 102 according to desired design parameters. For example, in the general direction from rear end 106 to front end 108 of loudspeaker 100, the cross-sectional area of the interior volume defined by horn 104 typically increases along one or more axial lengths of loudspeaker 100. That is, throat section 112 and/or waveguide section 114, or portions of throat section 112 and/or waveguide section 114, can be tapered or flared outwardly from the central longitudinal axis of horn 104 so as to increase the cross-sectional area of the interior volume in the vertical and/or horizontal directions, i.e., to provide vertical and/or horizontal expansion. Other portions of throat section 112 and/or waveguide section 114 can define regions having constant distances from the central longitudinal axis that do not contribute to vertical and/or horizontal expansion.

Figure 2:
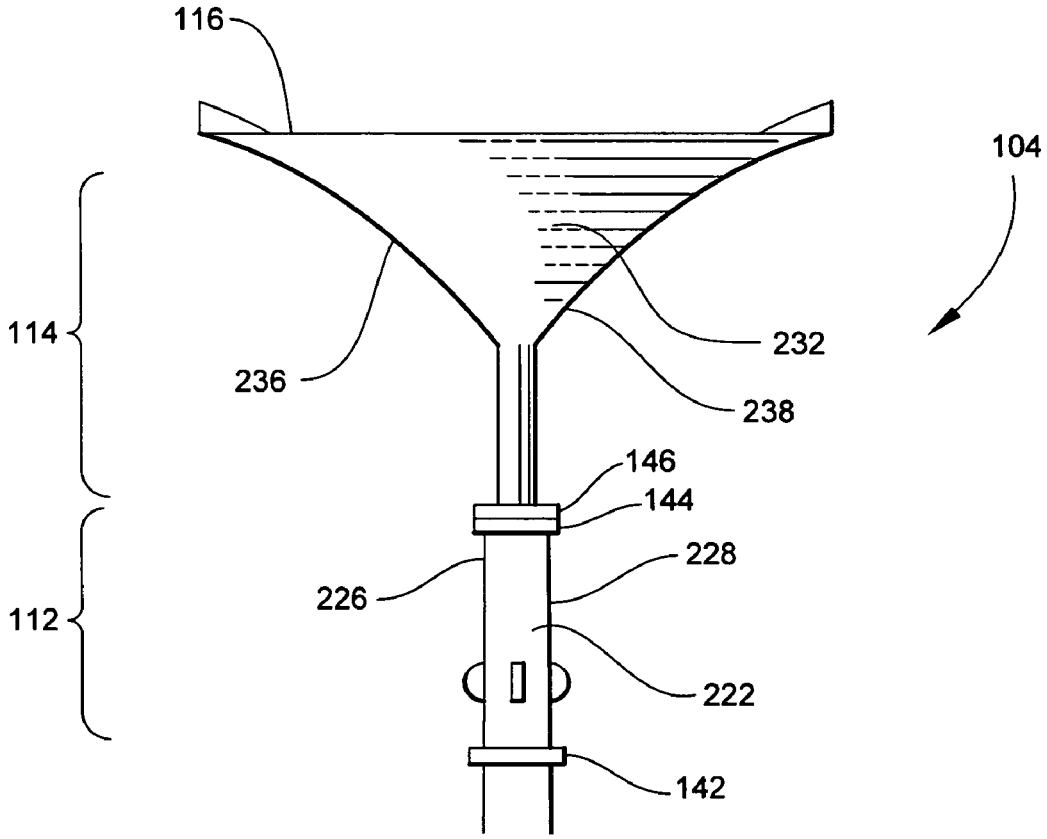
FIG. 2 is a top plan view of the loudspeaker illustrated in FIG. 1.

FIG. 2 is a top plan view of horn 104 of loudspeaker 100. As illustrated in FIG. 2, throat section 112 includes a top wall 222, a first side wall 226, and an opposing second side wall 228. Similarly, waveguide section 114 includes a corresponding top wall 232, a first side wall 236, and an opposing second side wall 238. In the exemplary implementation illustrated in FIG. 2, first and second side walls 226 and 228 of throat section 112 do not appreciably diverge from the central vertical plane of horn 104 and thus do not contribute to horizontal expansion of horn 104. On the other hand, in at least a portion of waveguide section 114, first and second side walls 236 and 238 of waveguide section 114 diverge from the central vertical plane to provide horizontal expansion in at least this portion.

Figure 3:
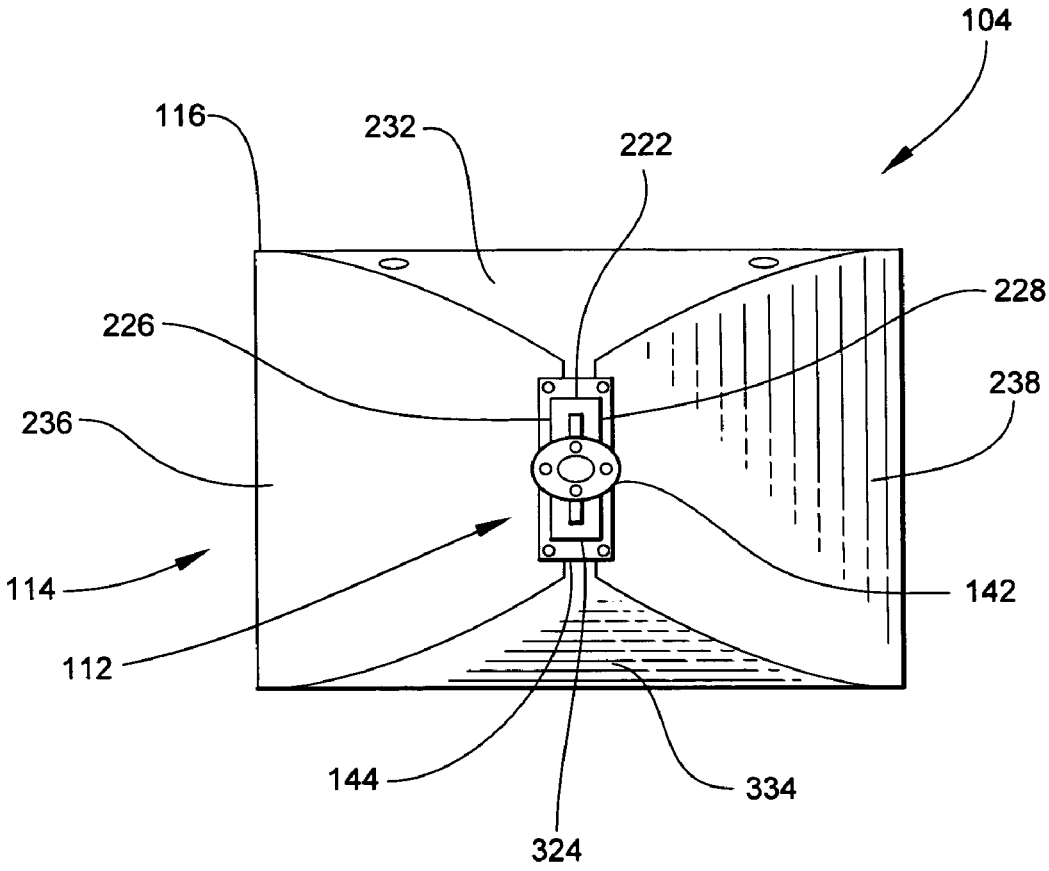
FIG. 3 is a rear elevation view the loudspeaker illustrated in FIG. 1.

FIG. 3 is a rear elevation view of horn 104 of loudspeaker 100. As shown in FIG. 3, throat section 112 further includes a bottom wall 324 disposed opposite top wall 222. Similarly, waveguide section 114 includes a bottom wall 334 disposed opposite top wall 232.

Figure 4:
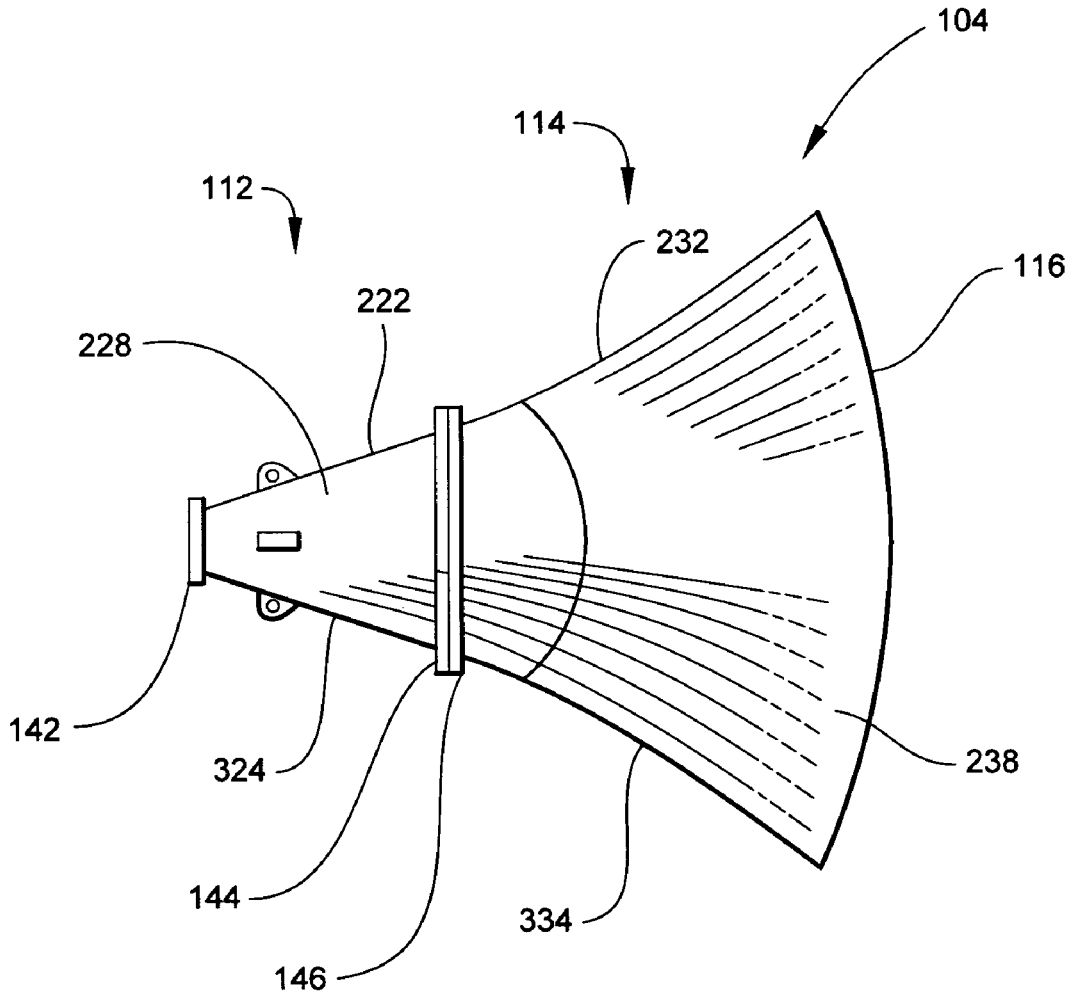
FIG. 4 is a side elevation view of the loudspeaker illustrated in FIG. 1.

FIG. 4 is a side elevation view of loudspeaker 100. In the exemplary implementation illustrated in FIG. 4, top wall 222 and bottom wall 324 of throat section 112 diverge from the central horizontal plane of horn 104 and thus provide vertical expansion. Top wall 232 and bottom wall 334 of waveguide section 114 also diverge from the central horizontal plane to provide addition vertical expansion. Thus, in this example, waveguide section 114 is shaped to provide significant horizontal expansion and some vertical expansion as well.

It can be seen from the foregoing description that various inside surfaces of horn 104 of loudspeaker 100 facing the interior defined by horn 104 are useful for directing sound energy emanating from driver 102 to mouth 116, from which the sound energy is then dispersed into the ambient environment as sound waves in a manner dictated by the design of horn 104. Accordingly, many of these inside surfaces, such as the inside surfaces of top wall 222, bottom wall 324, first side wall 226, and second side wall 228 of throat section 112 can be exposed to high-energy sound pressure. While sound energy is directed through horn 104 as guided by the internal contours of horn 104 defined by its inside surfaces, some sound vibrations may travel through the thickness of one or more walls to the outside surfaces of such walls. These sound vibrations are typically undesirable due to their potential influence on the directivity and overall acoustic performance of loudspeaker 100. The present subject matter addresses this problem by incorporating sound-damping material into one or more loudspeaker components (e.g., horn 104, throat section 112 and/or waveguide section 114) or portions of loudspeaker components. As will become evident from the remaining description, the sound-damping material is incorporated into one or more loudspeaker components in a manner that does not impair the structural integrity of such loudspeaker components.

Figure 5:
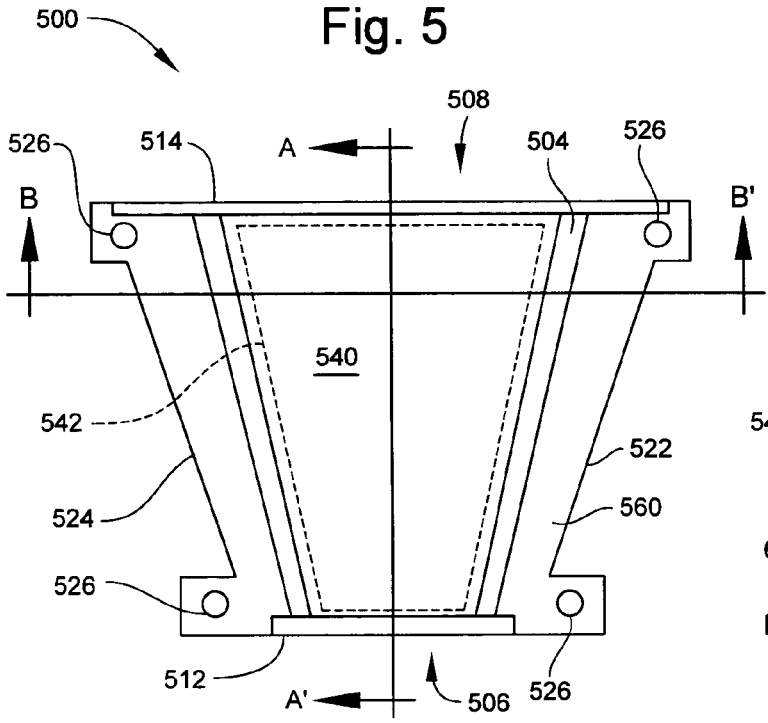
FIG. 5 is a plan view of a horn section of a loudspeaker, as illustrated in FIG. 1, where a sound-damping structure has been incorporated according to an embodiment of the present disclosure.
Figure 7:
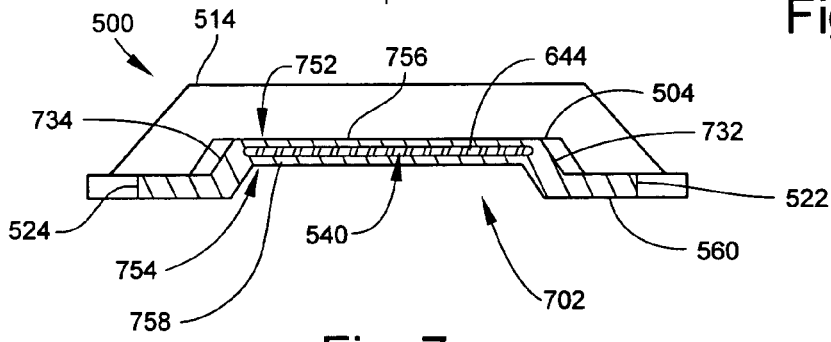
FIG. 7 is a cross-sectional view of the horn section illustrated in FIG. 5, taken through line B-B' of FIG. 5.

FIG. 5 is a plan view of a loudspeaker component 500 for which sound-damping functionality has been provided in at least a portion, such as a panel-like region, of loudspeaker component 500. In the specific example illustrated, loudspeaker component 500 is a half-section of a throat section of a horn (e.g., throat section 112 illustrated in FIGS. 1-4), although it will be understood that the sound-damping functionality can be implemented in any other loudspeaker component. In this example, loudspeaker component 500 at least partially defines an interior (generally designated 702 in FIG. 7) of a horn through which sound energy is directed. Loudspeaker component 500 includes a side wall 504 extending between a rear end 506 and a front end 508 of loudspeaker component 500. Side wall 504 can be substantially flat, curved, or both flat and curved as needed to define a desired contour for interior 702 (FIG. 7). Side wall 504 extends between a radial flange or web 512 disposed at rear end 506 and a radial flange or web 514 disposed at front end 508. Radial flange 512 facilitates coupling of loudspeaker component 500 to a driver (e.g., driver 102 illustrated in FIG. 1), and radial flange 514 facilitates coupling of loudspeaker component 500 to a waveguide section or mouth (e.g., waveguide section 114 or mouth 116 illustrated in FIG. 1). A first lateral flange 522 and a second opposing lateral flange 524 extend outwardly on either side of the central longitudinal axis of loudspeaker component 500. First and second lateral flanges 522 and 524 can serve any number of purposes, such as facilitating the coupling of loudspeaker component 500 as a half-section to a similar half-section loudspeaker component in the assembly of a throat section. In addition, first and second lateral flanges 522 and 524 can include apertures 526 or other mounting features as desired or needed in a given implementation.

As further shown in FIG. 5, a sound-damping core or layer 540 is incorporated into side wall 504 and has an outer perimeter or boundary 542 as depicted by the dashed outline. The area covered by sound-damping core 540 can constitute all or a portion of the total area of side wall 504, and can accommodate the profile of side wall 504 (e.g., flat, curved, or both flat and curved) as well as the shape of side wall 504 (e.g., trapezoidal). An end or edge region (or margin) 560 is formed around the periphery of sound-damping core 540.

Figure 6:
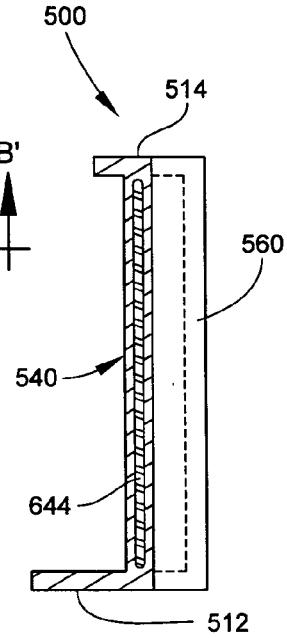
FIG. 6 is a cross-sectional view of the horn section illustrated in FIG. 5, taken through line A-A' of FIG. 5.

FIG. 6 is a cross-sectional view of loudspeaker component 500 taken along line A-A' of FIG. 5. From this perspective, it can be seen that sound-damping core 540 comprises a part of a multi-layer laminate 644 of loudspeaker component 500.

FIG. 7 is a cross-sectional view of loudspeaker component 500 taken along line B-B' of FIG. 5. As shown in FIG. 7, side wall 504 can be raised from the plane along which first and second lateral flanges 522 and 524 are disposed to at least partially define the interior volume 702 of a throat. In some embodiments, this configuration defines a top wall 732 and a bottom wall 734 of a throat, or portions of top wall 732 and bottom wall 734. The thickness of side wall 504 extends between an outside surface 752 at which it is desired to suppress sound vibrations and an inside surface 754 that is exposed to high-energy sound pressure in interior 702. To suppress sound vibrations traveling through the thickness, side wall 504 is constructed as a multi-layer laminate 644 of which sound-damping core 540 comprises one of the layers. In the example specifically illustrated in FIG. 7, side wall 504 is constructed as a three-layer laminate 644 in which sound-damping core 540 is embedded within the thickness of side wall 504 by constructing side wall 504 from a first structural or surface layer 756 and a second structural or surface layer 758. First structural layer 756 presents outside surface 752 of side wall 504, second structural layer 758 presents inside surface 754 of side wall 504, and sound-damping core 540 is interposed between first and second structural layers 756 and 758.

First and second structural layers 756 and 758 are molded, bonded, adhered, or otherwise coupled or adjoined together so as to form an essentially solid or unitary structure, but with a sealed core or pocket in which sound-damping material 540 is disposed. That is, beyond the boundaries of three-layer laminate 644 (i.e., boundary 542 shown in FIG.

5), first and second structural layers 756 and 758 merge to form one or more end or edge regions or margins 560 around the periphery of the three-layer laminate 644. End region 560 serves in part to define the core and retain sound-damping material 540 within the core, as well as to maintain the structural rigidity of loudspeaker component 500. In addition, end region 560 can serve as a relatively thick mounting or fastening region for loudspeaker component 500. For this purpose, end region 560 can include first and second lateral flanges 522 and 524, apertures 526 or any other suitable mounting features as previously noted.

First and second structural layers 756 and 758 can be constructed from any material suitable for use as rigid structural features of a sound-directing component of a loudspeaker. The material comprising first and second structural layers 756 and 758 can include, but is not limited to, any suitable thermosetting molding compound that is commercially available in uncured bulk, thick and sheet forms, such as sheet molding compound or SMC, thick molding compound, bulk molding compound, and low-pressure molding compound (LPMC). Examples of thermosetting molding compounds include various types of thermosetting resins or resin-containing compounds such as, but not limited to, epoxy (polyether) resins in a styrene monomer, and resins reinforced with fiberglass material. Moreover, the material comprising first and second structural layers 756 and 758 can be any material suitable for use in processes such as compression molding, resin transfer molding, and rim molding. Sound-damping material 540 can include any material suitable for damping, absorbing or isolating acoustic energy. Examples of suitable sound-damping materials can include, but are not limited to, mineral-filled damping material, filled vinyl copolymer compounds, filled silicon rubber compounds, balsa wood, corrugated materials, and foam materials.

In one example of the construction of loudspeaker component 500, first and second structural layers 756 and 758 are co-molded in a single molding operation with a layer or matrix of sound-damping material 540. Three layers are laid in a mold in a suitable molding machine: (1) a first layer of initially uncured thermosetting molding compound; (2) sound-damping material 540, extending only across the area to be sound-damped (e.g., the area enclosed by outline 542 in FIG. 5); and (3) a second layer of initially uncured thermosetting molding compound, along with any additional small pieces that may be required for build-up in the end regions 560. For example, the first layer can be laid into the molding machine, the core layer of sound-damping material 540 laid onto the first layer and positioned so as to define the peripheral margin of uncured molding material, and the second layer laid onto the first layer and core layer substantially in outline registration with the first layer. Heat and pressure are applied to the uncured layered stack to flow-mold and thermoset the molding material. The molding material layers are cured as a result of this molding process. At the edge regions 560, the molding material layers are bonded or integrated so as to form a single homogeneous mass of cured molding material that serves both as a peripheral seal to retain sound-damping material 540 and as a structural portion of loudspeaker component 500, as well as a functional flange, mounting or attachment region for loudspeaker component 500. The edge regions 560 thus consist entirely of the thermosetting molding material and can be molded to any thickness and configuration desired. The mold can be configured such that the resulting first and second structural layers 756 and 758 have the same boundary outlines and sound-damping material 540 has a smaller outline enclosed within the larger outlines of first and second structural layers 756 and 758. The differential space between the larger and smaller outlines can substantially correspond to the resulting edge regions 560.

Edge regions 560 can have a uniform thickness if desired, and can have the same thickness as the laminated section 644 or a different thickness. The layers making up the laminated section 644 (first structural layer 756, core layer 540, and second structural layer 758) can each have the same thickness or different thicknesses. In one embodiment, each layer has a thickness of 0.125 inch for a total thickness of 0.375 inch.

While the exemplary embodiments described above relate to a loudspeaker component 500 in the form of a horn, it will be understood that the subject matter also entails other types of loudspeaker components such as waveguides, enclosures, housings, cabinets, and the like.

The foregoing description of an implementation has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. A loudspeaker comprising:

a sound-directing component having at least one wall;

a sound damping portion embedded in the wall of the sound-directing component, the sound damping portion comprising:

(a) a first structural layer including a generally rigid material and an outside surface facing an exterior of the sound-directing component;

(b) a second structural layer including an inside surface facing an interior of the sound-directing component through which sound energy is directed; and (c) a core layer enclosed between the first and second structural layers and including a sound-damping material.

2. The loudspeaker according to claim 1 where the first and second structural layers comprise a thermo-setting material.

3. The loudspeaker according to claim 1 where the first and second structural layers comprise a resin material.

4. The loudspeaker according to claim 1 where the sound-damping material comprises a mineral-filled material.

5. The loudspeaker according to claim 1 where the sound-damping material comprises a vinyl copolymer.

6. The loudspeaker according to claim 1 where the sound-damping material comprises a silicon rubber.

7. The loudspeaker according to claim 1 where the sound-damping material comprises balsa wood.

8. The loudspeaker according to claim 1 where the sound-damping material comprises a corrugated material.

9. The loudspeaker according to claim 1 where the sound-damping material comprises a foam material.

10. The loudspeaker according to claim 1 where at least a portion of the first and second structural layers are adjoined to each other to form an edge region surrounding the core layer.

11. The loudspeaker according to claim 1 where the first structural layer, second structural layer, and core layer form a part of a loudspeaker horn.

12. A sound-directing component of a loudspeaker, the sound-directing component comprising:

(a) a first surface layer including a molding material and having a boundary outline;

(b) a core layer including a sound-damping material and having a boundary outline smaller than that of the first layer such that the first layer forms a peripheral margin of molding material at the boundary outline of the core layer, where the peripheral margin extends to form a throat section of the sound-directing component for directing sound energy of the loudspeaker; and (c) a second surface layer including the molding material and having a boundary outline similar to that of the first surface layer and located in substantial registration therewith, the second surface layer adjoined to the first surface layer at the peripheral margin so as to form a sealed core region in which the core layer is disposed.

13. The sound-directing component according to claim 12 where the molding material is a thermosetting resin.

14. The sound-directing component according to claim 12 where the sound-damping material is selected from the group consisting of mineral-filled material, vinyl copolymer, silicon rubber, balsa wood, corrugated material, and foam material.

15. The sound-directing component according to claim 12 where the margin comprises a first flange and a second flange.

16. The sound-directing component of a loudspeaker, the sound-directing component, comprising:

(a) a first layer;

(b) a second layer fixed to the first layer to define a core and a margin, the margin including a first flange and a second flange, the first and second flanges extending to form a throat section of the sound-directing component to direct sound of the loudspeaker; and (c) sound-damping material disposed in the core so as to be completely encased by the first and second layers.

17. The sound-directing component according to claim 16 where the core defines a trapezoid.

18. The sound-directing component according to claim 16 where the margin comprises a solid structure.

19. The sound-directing component according to claim 16 where the first layer, the sound-damping material, and the second layer comprise a three-layer laminate, and the first and second flanges extend to raise the three-layer laminate so that an interior surface of the second layer defines the throat.

20. The sound-directing component according to claim 19 where the margin and the three-layer laminate define a thickness that is substantially constant throughout the margin and the three-layer laminate.

21. The sound-directing component according to claim 16 where the respective thickness of the first layer, the sound-damping material, and the second layer are substantially equal.

22. The sound-directing component according to claim 16 where the first layer, the sound-damping material, and the second layer comprise no more than a three-layer laminate.

23. The sound-directing component according to claim 16 where the first and second flanges extend away from each other at an acute angle.

24. The sound-directing component according to claim 16 where the first and second flanges are constructed from individual pieces formed together as a single substantially homogeneous mass of cured molding material.

25. The sound-directing component according to claim 16 where the sound-damping material comprises a mineral-filled damping material.

26. The sound-directing component according to claim 16 where the sound-damping material comprises a solid material.

27. The sound-directing component according to claim 26 where the solid material comprises a vinyl copolymer compound.

28. The sound-directing component according to claim 26 where the solid material comprises balsa wood.

29. The sound-directing component according to claim 16 where the first layer comprises a material selected from the group consisting of sheet molding compound, bulk molding compound, thick molding compound, fiberglass filled epoxy resin, fiberglass filled polyether resin, and fiberglass-filled polyester resin in a styrene monomer.

* * * * *